US005557992A

United States Patent [19]

Macor

[11] Patent Number: 5,557,992

[45] Date of Patent: Sep. 24, 1996

[54] MULTI-SOCKET WRENCH CONTAINING DUAL SOCKET WRENCH UNITS

[75] Inventor: Richard J. Macor, Greenwich Township, Warren County, N.J.

[73] Assignee: Proprietary Technologies, Inc., Stewartsville, N.J.

[21] Appl. No.: 364,697

[22] Filed: Dec. 28, 1994

Related U.S. Application Data

[63] Continuation-in-part of Ser. No. 96,383, Jul. 23, 1994, abandoned, which is a continuation-in-part of Ser. No. 864,972, Apr. 7, 1992, Pat. No. Des. 342,653.

[51] Int. Cl.[6] ..... B25B 13/06

[52] U.S. Cl. ..... 81/124.5; 81/57.5; 81/124.4; 81/125.1

[58] Field of Search ..... 81/124.3, 124.4, 81/124.5, 124.7, 125.1, 57.5

[56] References Cited

U.S. PATENT DOCUMENTS

| | | | |
|---|---|---|---|
| 1,410,032 | 3/1922 | Palmer . | |
| 1,494,513 | 5/1924 | Stewart et al. . | |
| 1,571,148 | 1/1926 | Sisolak . | |
| 1,613,976 | 1/1927 | Bellows . | |
| 1,645,999 | 10/1927 | Reboul | 81/57.5 |
| 1,796,083 | 3/1931 | Carlberg . | |
| 1,930,238 | 10/1933 | Heller . | |
| 2,453,901 | 11/1948 | Gonsett et al. . | |
| 3,745,860 | 7/1973 | Bennett . | |
| 5,048,379 | 9/1991 | Gramera et al. . | |

FOREIGN PATENT DOCUMENTS

| | | |
|---|---|---|
| 357741 | 12/1920 | Germany . |
| 409566 | 5/1934 | United Kingdom . |

*Primary Examiner*—D. S. Meislin
*Attorney, Agent, or Firm*—Kenneth P. Glynn

[57] ABSTRACT

The present invention multi-socket wrench includes an elongated main member with an upper area, lower area, a first end, a second end and at least two wrench units, e.g. four wrench units. Each wrench unit has an elongated dimension, and each wrench unit has only two sockets, positioned side by side thereon. Two wrench units are rotatably attached, one each at the upper and lower areas of the first end of the elongated main member. There is also a wrench unit attachment mechanism which provides for the substantial alignment of an outer positioned socket of the upper attached wrench unit with an outer positioned socket of the lower attached wrench unit. In some embodiments, sockets of the lower attached wrench unit have a diameter at least 55% the diameter of an aligned socket of an upper attached wrench unit. In other embodiments the upper attached wrench unit is fixedly connected to the lower attached wrench unit so that rotation of one of the connected wrench units causes coincidental rotation of the other of the connected wrench units. Still in another preferred embodiment, the wrench has two wrench units attached at the first end and two wrench units attached at the second end, combining to form a wrench having eight different sizes.

20 Claims, 2 Drawing Sheets

MULTI-SOCKET WRENCH CONTAINING DUAL SOCKET WRENCH UNITS

REFERENCE TO RELATED CASE

This application is a continuation-in-part of currently U.S. patent application Ser. No. 08/096,383, filed on Jul. 23, 1994, by Richard J. Macor, entitled "Multi-Socket Wrench", now abandoned, which itself was a continuation-in-part of U.S. patent application Ser. No. 07/864,972, filed on Apr. 7, 1992 by the same inventor herein, and entitled "Eight-Size Box Wrench", now U.S. Design Patent Des. 342,653.

BACKGROUND OF THE INVENTION

1. Field of the Invention

The present invention relates to box wrenches and, more particularly, a box wrench which has multi-socket capabilities. Thus, the present invention involves a single tool which may hold four, six, eight or even more different sizes and which may be an open or closed socket wrench.

2. Information Disclosure Statement

Metal wrenches have been around for more than 100 years and various configurations have been developed involving the use of multiple socket or multiple size wrenches. The following is representative of the prior art:

U.S. Pat. No. 3,745,860, issued to Robert Bennett describes a handyman's wrench which involves a series of wrench inserts with socket openings stored in the wrench handle and part of the handle pivots so as to be rotatable whereby the stored socket openings are interchangeable to allow a user to select a desired socket size.

U.S. Pat. No. 2,453,901 issued to Gonsett et al describes a compound wrench and screw driver which includes a plurality of wrench socket sizes with slidable smaller sockets within larger sockets to permit multiple size usage at opposite ends of an elongated main member.

U.S. Pat. No. 1,930,238 issued to Arthur Heller describes a multiple socket wrench which has sockets located on various sides of a cube-like structure with the structure rotatable to present different socket sizes for use.

U.S. Pat. No. 1,796,083 issued to August Carlberg likewise describes a wrench having a plurality of sockets located on a rotatable structure on opposite ends of a main body.

U.S. Pat. No. 1,613,976 issued to Warren Bellows shows multiple size wrench arrangements utilizing rotatable structures having various socket sizes thereon.

Also, U.S. Pat. Nos. 1,571,148 and 1,410,032 describe rotating socket members which offer various sizes and which are attached to ends of elongated handles.

Finally, U.S. Pat. No. 1,494,513 issued to James Stewart et al describes a wrench with multiple sockets which extends outwardly and sequentially to offer different sizes.

German Pat. No. 357,741 dated Dec. 20, 1920, provided in German by the Examiner of the parent case hereto, and British Pat. No. 409,566, accepted May 3, 1934, both illustrate wrench tools having a main body and wheels which contain four or five wrench sizes on each end. The German patent shows open end wrenches and the British Patent shows closed sockets. Neither of these illustrate dual socket-containing units, much less the specific wrench units and arrangements set forth and claimed herein.

U.S. Pat. No. 5,048,379 to Gramera et al. describes double-ended, hollow core socket wrenches, tooled for either an English or metric size nut and bolt engaging means in one socket cavity and tooled for either the closest English or closest metric equivalent size nut and bolt engaging means in the opposite socket cavity, are designed to engage and turn hexagonal nuts on protruding bolt studs. The first type of double-ended socket has an axially central external hexagonal surface drive engaging portion, raised from its' substantially cylindrical shell portion, so that it can be driven externally with a single-ended socket wrench drive member, while the second type of double-ended socket, designed with the same outer drive mechanism described for the first type, has in addition, an internal axially central square drive well engaging portion, accessible from either open socket end, by a conventional extension drive rod member. Whereas, the first type of double-ended socket is designed to engage smaller sizes of nuts and bolts, the second type of double-ended socket is designed to engage larger sizes of nuts and bolts. A combination of both types of double-ended socket wrenches, provides a complete set of hand tools that will engage a full range of small and large English and metric size fittings of regular depth hexagonal nuts and bolts and deep well hexagonal nuts on protruding bolt studs.

Notwithstanding the above cited prior art, no patent teaches or renders obvious the present invention multi-socket wrench utilizing a plurality of wrench units which rotate about a central vertical axis with each such wrench unit having two sockets thereon, and wherein each of the sockets have a central axis substantially parallel to the vertical central axis, and with the vertical central axis being at about right angles to the elongated dimension of the elongated main member of the wrench.

SUMMARY OF THE INVENTION

The present invention multi-socket wrench includes an elongated main member with an upper area, lower area, a first end, a second end and at least two wrench units, e.g. four wrench units. Each wrench unit has an elongated dimension, and each wrench unit has only two sockets positioned side by side thereon. Two wrench units are rotatably attached, one each at the upper and lower areas of the first end of the elongated main member. There is also a wrench unit attachment means which provides for the substantial alignment of an outer positioned socket of the upper attached wrench unit with an outer positioned socket of the lower attached, wrench unit. In some embodiments, sockets of the lower attached wrench unit have diameters at least 55% the diameter of aligned sockets of the upper attached wrench unit. In other embodiments, the upper attached wrench unit is fixedly connected to the lower attached wrench unit so that rotation of one of the connected wrench units causes coincidental rotation of the other of the connected wrench units. In some embodiments, the present invention wrenches include wrench units at both a first end and a second end.

BRIEF DESCRIPTION OF THE DRAWINGS

The present invention is more fully understood when the specification herein is taken in conjunction with the drawings appended hereto, wherein.

DETAILED DESCRIPTION OF THE INVENTION

Figure 1:
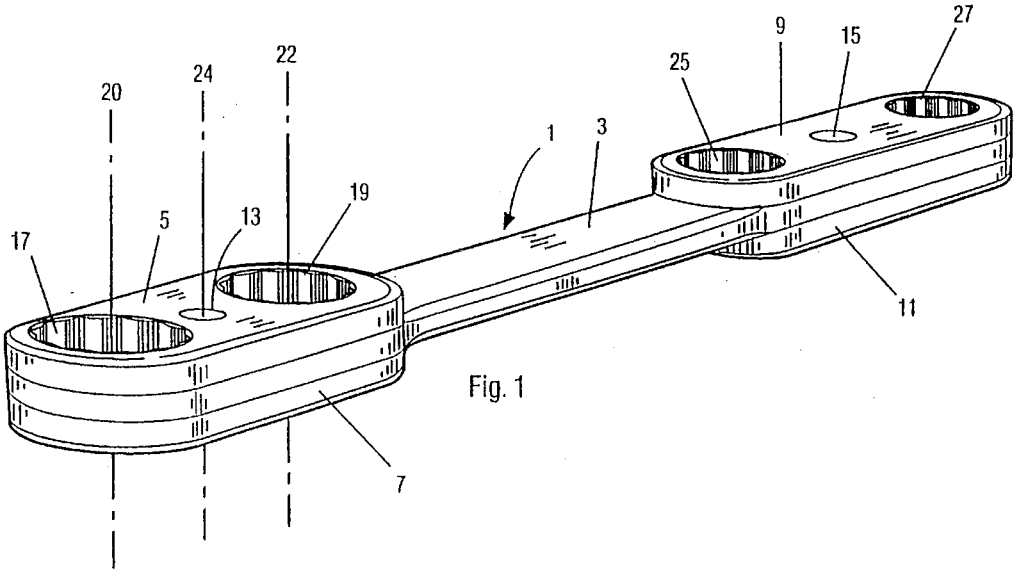
FIG. 1 shows a side oblique view of a present invention wrench and, FIGS. 2 and 3 show top and bottom views thereof, respectively.

The present invention is, as mentioned, a multi-socket wrench which includes an elongated main member which is adapted to retain one or more rotatable wrench units. This main member is elongated at least to the extent that it would have at least a first end which would receive two of the rotatable wrench units. Thus, the elongated main member is basically a central portion of the tool which acts at one or both extremities as a working end and which acts as well as a handle and fulcrum member for the user. The wrench units each have only two sockets of different sizes thereon. Each wrench unit has a vertical central axis through it with the sockets generally located opposite the central axis and concentric to the central axis and each having a socket central axis substantially parallel to said vertical central axis. Each of the wrench units is rotatably attached to the main member and this may be in the form of having only two wrench units at a first end of the elongated main member, or having only two wrench units on each of the first end and the second end of the elongated main member, or other connections. For example, the elongated main member may have two wrench units at one end and only one at the other end, however, more logically and preferably, the elongated main member has two wrench units at its first end and two wrench units at its second end. In all embodiments, each wrench unit has, as mentioned, two sockets, and, therefore the most preferred embodiment, just mentioned, results in an eight-size box wrench.

The sockets used in the present invention may be metric or standard size or otherwise. Preferably, the sizes of the sockets collectively are sequential and constitute what is recognized in the tool industry as a series or set of sockets.

However, the present invention sockets should generally be aligned with sockets having a cross-section, (a width, average width or otherwise measured) which is at least 55% or more, of that of the socket with which it is aligned. Thus, the two sockets located on an upper first end and a lower first end are chosen to achieve this result. Further, since a means for attaching wrench units is used, the upper and lower wrench units may rotate together to maintain an ideal socket alignment.

Thus, the present invention device is uniquely arranged to afford optimum usage with optimum design. The multi-socket wrench of the present invention has a means for attaching the wrench units to the elongated main member. The means for attaching the wrench units may be integral with either the elongated main member or with the wrench units, or may be separate means. One means for attaching wrench units may be used for each wrench unit, or for each pair of wrench units, i.e. for two wrench units located on the same end (first end or second end) of the elongated main member, that is an aligned upper attached wrench unit and an aligned lower attached wrench unit on the same end. In preferred embodiments, the means for attaching wrench units connects two aligned wrench units (corresponding wrench units) to one another. By this manner of connection, a wrench unit (upper or lower) when rotated, will concomitantly rotate the other corresponding wrench unit with it.

The elongated main member is generally formed of metal, although it could be a combination of metal and plastic, for example, a metal core with a hard plastic handle such as an acrylic handle or otherwise. The wrench units are generally of strong metal such as is commonly used for wrench manufacturing and is well known by the artisan.

The present invention multi-socket wrench may be one wherein the sockets are closed or they may be open ended. Thus, as used throughout this application, it should be understood that the word "sockets" means closed as well as open ended sockets and these may have standard hexagonal configurations or other configurations having fewer than or greater than six sides without exceeding the scope of the present invention.

In preferred embodiments, the present invention multi-socket wrench is designed with compact proportions in mind. Therefore, the wrench units are relatively thin, and the sockets thereon relatively shallow. Occasionally, a user will encounter a nut positioned on a long, bolt threaded stud. Since the sockets are shallow, not deep, the nut engaging socket will not access the nut unless the threaded stud can pass through the aligned socket of the corresponding wrench unit. Therefore, the aligned socket of the corresponding wrench unit must have a diameter at least as wide as the threaded stud. Usually, a bolt threaded stud is approximately 66% the diameter of the same bolt head or nut. Therefore, any socket on any wrench unit, must be provided alignment with another socket of a corresponding wrench unit that has a diameter equal to or greater than 66% the diameter of the other aligned socket.

Please note that any two aligned sockets must have a size relationship within the ranges of the following formula:

$$B \geqq (A \times 0.66),$$

wherein A represents the diameter of an outer positioned socket of an upper attached wrench unit, and B represents the diameter of an aligned, outer positioned socket of a corresponding lower attached wrench unit. A broader formula providing for manufacturing deviation could be:

$$B \geqq (A \times 0.55),$$

wherein A and B are as defined, and still yield practical results in normal size gradation wrenches.

Figure 2:
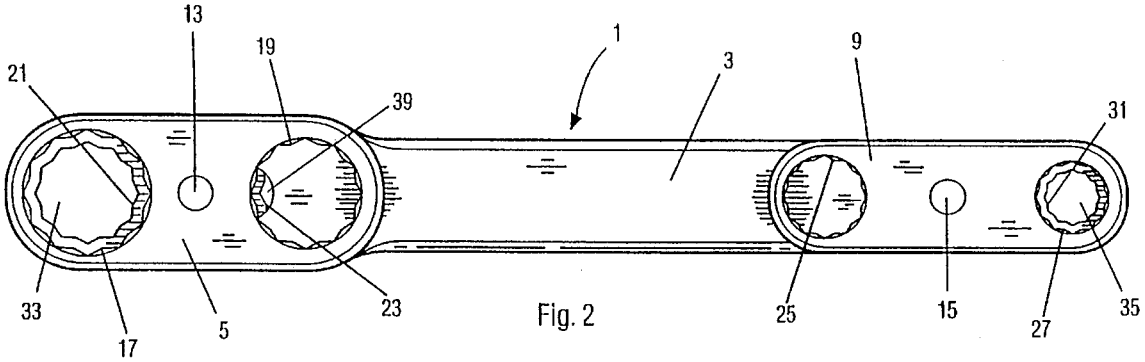
Figure 3:
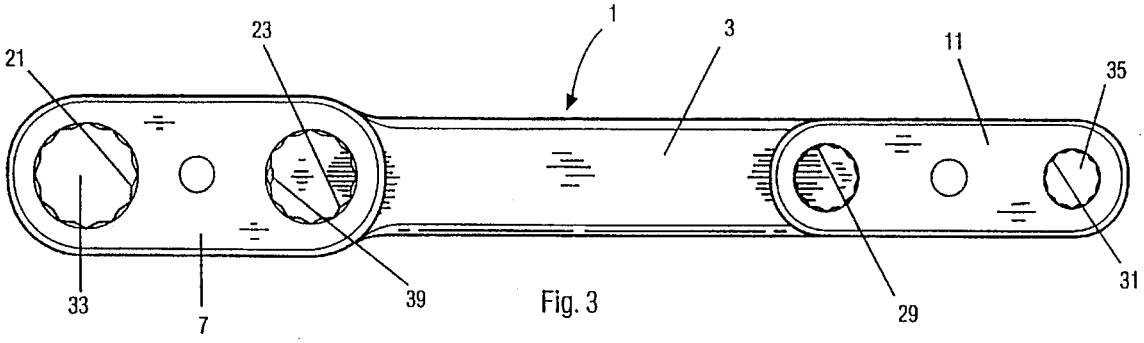

Referring now to FIGS. 1, 2 and 3 simultaneously, there is shown in FIG. 1 an oblique side view of present invention multi-socket wrench 1 and this is shown in its top view in FIG. 2 and its bottom view in FIG. 3. There is an elongated main member 3, as shown. It is generally constructed of parallel sides and tops and bottoms with its right side being of equal width to its central section and with its left side being of expanded width to accommodate larger size sockets which are contained within the socket unit members on the left side.

More specifically, as shown in these Figures, there is a wrench unit 5 and a second wrench unit 7 located on the left end of elongated main member 3 and wrench unit 5 and wrench unit 7 have a common vertical central axis represented by pivot axle 13. Thus, wrench unit 5 is above elongated main member 3 and wrench unit 7 is below it. Likewise, at the opposite side of elongated main member 3 is wrench unit 9 on the top, and wrench unit 11 on the bottom. These have a common vertical central axis which is represented by pivot axle 15. Each of the wrench units 5, 7, 9 and 11 are arranged so as to rotate either clockwise or counterclockwise about its vertical central axis, or in this case pivot axles 13 and 15 respectively.

Wrench unit 5 includes a first size socket 17 and a second size socket 19 and wrench unit 7 has a third socket size 21 and a fourth socket size 23. These are clearer in FIGS. 2 and 3. Likewise, wrench unit 9 has a fifth size socket 25 and a sixth size socket 27 and, finally, wrench unit 11 has a seventh size socket 29 and an eighth size socket 31, as shown. Elongated main member 3 includes orifices 33 and 35 to allow for maximum usage of the present invention multi-socket wrench 1, thus, for example, enabling a bolt to extend therethrough to permit the tool to have a socket fit onto a nut of identical size. The socket sizes are arranged so as to align with one another whereby one socket aligned with another socket always has at least 55% of the cross-section of the other, mentioned above, to permit a bolt stud to pass therethrough.

Note that, in FIG. 1, first size socket 17 and second size socket 19 have central axes 20 and 22, respectively, which represent the direction of the sockets themselves and which are substantially parallel to central vertical axis 24 about which they are rotatable. Likewise, the relationship between the central vertical axis of rotation and for all of the other sockets in the present invention devices is that they are substantially parallel to one another and aligned, as shown.

The sockets 17, 19, 21, 23, 25, 27, 29 and 31 may be of any size desired but are preferably arranged in sequential sizes, as represented by the drawings and may either be metric or standard size sockets. For example, a preferred sizing arrangement may be ¾, 11/16, ⅝, 9/16, ½, 7/16, ⅜ and 5/16 inches.

Also, shown in FIGS. 2 and 3 is round portion 39 of a locking slot discussed further in conjunction with FIGS. 6 and 7 below.

Figure 4:
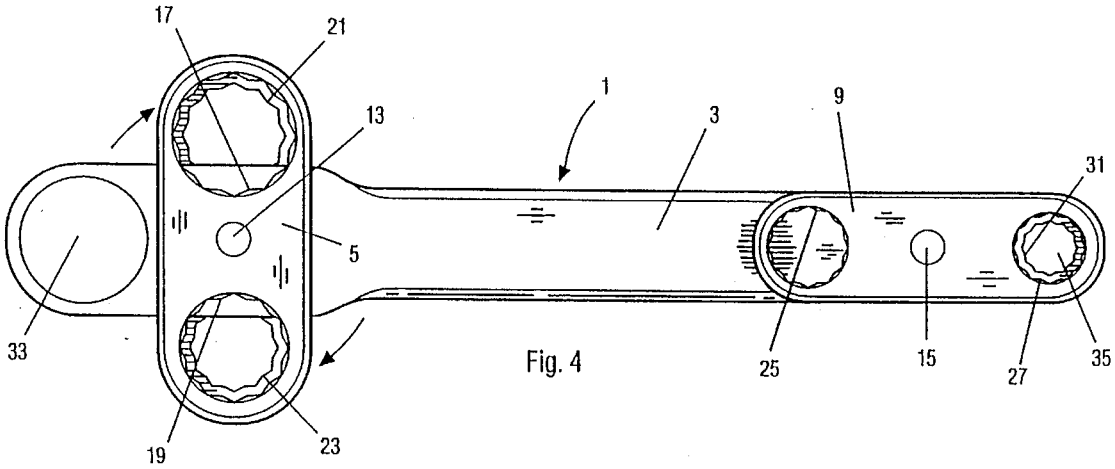
FIGS. 4 and 5 show top views of the wrench shown in FIGS. 1 through 3, but with one of the wrench units being rotated to alter the work position of the sockets thereon.
Figure 5:
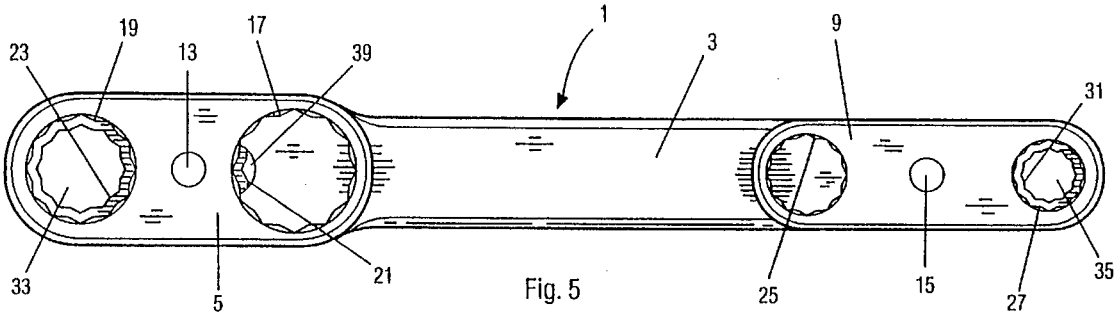

Referring now to FIGS. 4 and 5, there are shown top views of multi-socket wrench 1, as is shown in FIG. 2, with identical parts identically numbered. Here, however, wrench units 5 and 7 are being rotated in a clockwise manner as represented by the arrows in FIG. 4. As can be seen, the wrench units 5 and 7 are rotated together and thus, first size socket 17 is located on the inside, i.e. toward the midportion of elongated main member 3 instead of the outside, and second size socket 19 ends up on the outside. Likewise, third size socket 21 also ends up located on the inside of elongated main member 3 instead of the outside, and fourth size socket 23 ends up on the outside. In other words, through the rotation of socket unit members 5 and 7, it can be seen by comparing FIGS. 2 and 5 that the two sockets 17 and 19 have been juxtapositioned and the two sockets 21 and 23 have been juxtapositioned. Likewise, wrench units 9 and 11 can be rotated accordingly, and the result is that any of the eight different socket sizes available on this wrench 1 may be located at an outside position so as to rest over its opening 33 or 35, as shown.

Figure 6:
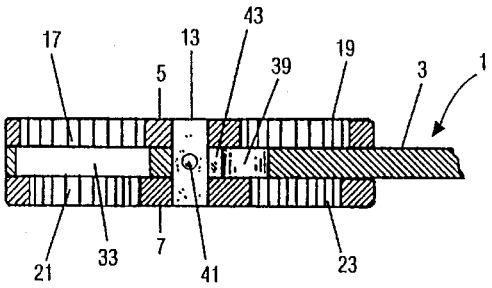
FIG. 6 shows a side cut view of a portion of a present invention wrench of FIGS. 1 through 5 above, illustrating a locking mechanism.

FIG. 6 shows the same wrench 1 as shown above but in a cut side view of the left end only. Here, a locking mechanism is shown to secure the wrench units into a first or second position, the first position being one having wrench units freely rotatable and located toward the inside, i.e. toward the midportion of the elongated main member so that a user may freely rotate the wrench units for socket selection. There is a second position, wherein the same wrench units are located on the outside and are locked into a non-rotatable position.

Figure 7:
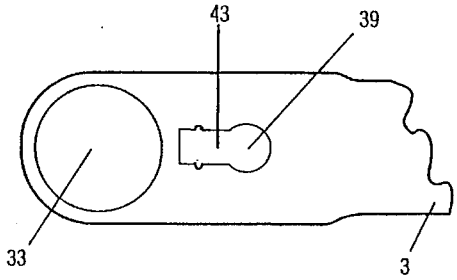
FIG. 7 shows a top partial view of the elongated main member of the previously shown present invention wrench, illustrating the locking slot; and, FIG. 8 shows a top view of an alternative present invention wrench wherein the sockets are open ended.

As can be seen in FIG. 6 and 7, the locking slot is made up of a keyway having a round portion 39 for free rotation and a locking portion 43 formed here as a rectangle. Thus, axle 13 in FIG. 6 has a rounded top and bottom, as shown in the other views but has a square or block midsection which rotates freely when in round portion 39 of FIGS. 6 and 7, but is not rotatable when in rectangular locking portion 43, as shown in FIGS. 6 and 7. Further, ball and a spring (not shown) facing the viewer, acts as a spring-and-ball lock which prevents free movement of axle 13 between the first position and the second position described above. Thus, a user will overcome the force of a spring against ball 41 in order to move axle 13 from its first position to its second position, and vice versa.

Figure 8:
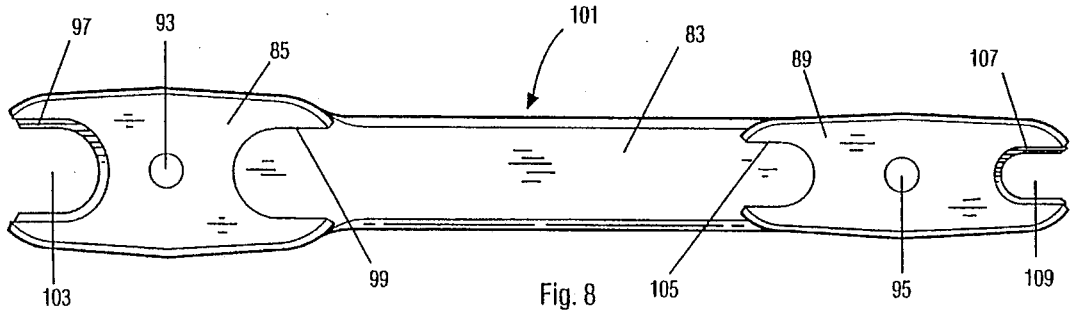

FIG. 8 shows a top view of an alternative embodiment device 101 wherein the sockets are open ended rather than closed ended. Here, there is an elongated main member 83 with wrench units such as wrench units 85 and 89 with vertical central axes of rotations represented by rotation axles 93 and 95. Wrench unit 85 has open end sockets 97 and 99 and wrench unit 89 has open end sockets 105 and 107, as shown. In this example, elongated main member 83 includes cut-outs 103 and 109 instead of orifices to accommodate the open end sockets.

Obviously, numerous modifications and variations of the present invention are possible in light of the above teachings. It is therefore understood that within the scope of the appended claims, the invention may be practiced otherwise than as specifically described herein.

What is claimed is:

1. A multi-socket wrench, which comprises:

(a) an elongated main member having an elongated dimension, with an upper area, lower area, a first end and a second end;

(b) at least two wrench units, each wrench unit having an elongated dimension and having opposing elongated ends, and each wrench unit having only two sockets, said two sockets being positioned side by side thereon, one of said at least two wrench units being rotatably attached at said upper area and another of said at least two wrench units being rotatably attached at said lower area of said first end of said elongated main member, said two sockets on each wrench unit being substantially opposite one another, each of said two sockets on each wrench unit being located at different opposing elongated ends of said wrench unit; and, (c) attachment means for attaching said wrench units to said elongated main member.

2. The multi-socket wrench of claim 1 wherein there is one means for attaching both an upper attached wrench unit and a lower attached wrench unit to said elongated main member so as to allow for the substantial alignment of any outer positioned socket of said upper attached wrench unit with any outer positioned socket of said lower attached wrench unit.

3. The multi-socket wrench of claim 1 wherein said attachment means permits rotation of said wrench units and includes a pivot point for said rotation, said pivot point, constituting a central axis, each of said two sockets on each wrench unit also having a central axis, and further wherein said pivot point central axis and said central axis for each of said two sockets are all substantially parallel and are all in a straight alignment with one another.

4. The multi-socket wrench of claim 1 wherein each of said two sockets have a central axis, and each of said opposing elongated ends of each wrench unit are arcuate over at least 180° thereof and have a center of curvature coincidental with said central axis of each of said two sockets.

5. The multi-socket wrench of claim 1 wherein said sockets are open end sockets.

6. The multi-socket wrench of claim 1 wherein said upper attached wrench unit is fixedly connected to said lower attached wrench unit by attachment means through said elongated main member and whereby rotation of one of said wrench units causes coincidental rotation of the other of said wrench units.

7. A multi-socket wrench, which comprises:

(a) an elongated main member having an elongated dimension, with an upper area, lower area, a first end and a second end;

(b) at least two wrench units, each wrench unit having an elongated dimension and having opposing elongated ends, and each wrench unit having only two sockets, said two sockets being positioned side by side thereon, one of said at least two wrench units being rotatably attached at said upper area and another of said at least two wrench units being rotatably attached at said lower area of said first end of said elongated main member, said two sockets on each wrench unit being substantially opposite one another, each of said two sockets on each wrench unit being located at different opposing elongated ends of said wrench unit; and, (c) attachment means for attaching said wrench units to said elongated main member wherein there is one attachment means for attaching both an upper attached wrench unit and a lower attached wrench unit to said elongated main member so as to allow for the substantial alignment of any outer positioned socket of said upper attached wrench unit with any outer positioned socket of said lower attached wrench unit.

8. The multi-socket wrench of claim 7 wherein said attachment means permits rotation of said wrench units and includes a pivot point for said rotation, said pivot point, constituting a central axis, each of said two sockets on each wrench unit also having a central axis, and further wherein said pivot point central axis and said central axis for each of said two sockets are all substantially parallel and are all in a straight alignment with one another.

9. The multi-socket wrench of claim 7 wherein each of said two sockets have a central axis, and each of said opposing elongated ends of each wrench unit are arcuate over at least 180° thereof and have a center of curvature coincidental with said central axis of each of said two sockets.

10. The multi-socket wrench of claim 7 wherein said sockets are open end sockets.

11. A multi-socket wrench, which comprises:

(a) an elongated main member having an elongated dimension, with an upper area, lower area, a first end and a second end;

(b) four wrench units, each wrench unit having an elongated dimension and having opposing elongated ends, and each wrench unit having only two sockets, said two sockets being positioned side by side thereon, said four wrench units being rotatably attached to said elongated main member, one at said upper area of said first end, one at said lower area of said first end, one at said upper area of said second end, and one at said lower area of said second end, said two sockets on each wrench unit being substantially opposite one another, each of said two sockets on each wrench unit being located at different opposing elongated ends of said wrench unit; and, (c) attachment means for attaching said wrench units to said elongated main member.

12. The multi-socket wrench of claim 11 wherein there is one means for attaching both an upper attached wrench unit and a lower attached wrench unit to said elongated main member so as to allow for the substantial alignment of any outer positioned socket of said upper attached wrench unit with any outer positioned socket of said lower attached wrench unit.

13. The multi-socket wrench of claim 11 wherein said attachment means permits rotation of said wrench units and includes a pivot point for said rotation, said pivot point, constituting a central axis, each of said two sockets on each wrench unit also having a central axis, and further wherein said pivot point central axis and said central axis for each of said two sockets are all substantially parallel and are all in a straight alignment with one another.

14. The multi-socket wrench of claim 11 wherein each of said two sockets have a central axis, and each of said opposing elongated ends of each wrench unit are arcuate over at least 180° thereof and have a center of curvature coincidental with said central axis of each of said two sockets.

15. The multi-socket wrench of claim 11 wherein said sockets are open end sockets.

16. The multi-socket wrench of claim 11 wherein an upper attached wrench unit is fixedly connected to a lower attached wrench unit by attachment means through said elongated main member and whereby rotation of one of said wrench units causes coincidental rotation of the other of said wrench units.

17. A multi-socket wrench, which comprises:

(a) an elongated main member having an elongated dimension, with an upper area, lower area, a first end and a second end;

(b) four wrench units, each wrench unit having an elongated dimension and having opposing elongated ends, and each wrench unit having only two sockets, said two sockets being positioned side by side thereon, said four wrench units being rotatably attached to said elongated main member, one at said upper area of said first end, one at said lower area of said first end, one at said upper area of said second end, and one at said lower area of said second end, said two sockets on each wrench unit being substantially opposite one another, each of said two sockets on each wrench unit being located at different opposing elongated ends of said wrench unit; and, (c) attachment means for attaching said wrench units to said elongated main member wherein there is one attachment means for attaching both an upper attached wrench unit and a lower attached wrench unit to said elongated main member so as to allow for the substantial alignment of any outer positioned socket of said upper attached wrench unit with any outer positioned socket said lower attached wrench unit.

18. The multi-socket wrench of claim 17 wherein said attachment means permits rotation of said wrench units and includes a pivot point for said rotation, said pivot point, constituting a central axis, each of said two sockets on each wrench unit also having a central axis, and further wherein said pivot point central axis and said central axis for each of said two sockets are all substantially parallel and are all in a straight alignment with one another.

19. The multi-socket wrench of claim 17 wherein each of said two sockets have a central axis, and each of said opposing elongated ends of each wrench unit are arcuate over at least 180° thereof and have a center of curvature coincidental with said central axis of each of said two sockets.

20. The multi-socket wrench of claim 17 wherein said sockets are open end sockets.

* * * * *